United States Patent [19]

Curry

[11] Patent Number: 4,463,981

[45] Date of Patent: Aug. 7, 1984

[54] TELESCOPING PROD

[76] Inventor: Cecil G. Curry, 615 Kenridge Cir., Stone Mountain, Ga. 30083

[21] Appl. No.: 387,157

[22] Filed: Jun. 10, 1982

[51] Int. Cl.[3] ..... B25B 9/00

[52] U.S. Cl. ..... 294/100; 294/61

[58] Field of Search ..... 294/100, 61, 33, 19 R; 43/6, 5, 18 R, 43

[56] References Cited

U.S. PATENT DOCUMENTS

| | | | |
|---|---|---|---|
| 2,320,611 | 6/1943 | Kandle | 294/100 |
| 2,690,927 | 10/1954 | Bean | 294/100 |
| 4,052,808 | 10/1977 | Grabtree | 294/61 |

*Primary Examiner*—James B. Marbert

*Attorney, Agent, or Firm*—James B. Middleton

[57] ABSTRACT

A telescoping prod for divers and the like, including a remotely operable pickup. Inner and outer tubular members telescope with respect to each other, and a set screw holds the two members in the desired position. The pickup includes spring fingers projectable from the extending end of the prod, the fingers being carried by a tube within the inner tubular telescoping member. The tube is held in the inner member, and a rod can either pass through the tube, or be locked to one end of the tube for operating the spring fingers from a distance. The end of the inner telescoping tubular member is threaded to receive various tools, or a visible locator. When folded, the prod is no longer than a person's thigh, and can be fastened along the thigh to allow free movement.

6 Claims, 4 Drawing Figures

TELESCOPING PROD

FIELD OF THE INVENTION

The invention relates generally to hand-carried tools and the like, and is more particularly concerned with a telescoping prod selectively usable for a variety of functions.

BACKGROUND OF THE INVENTION

There are numerous situations in which a person has need of a pole, or prod, and one frequently utilizes a conventional cane, or simply a broomstick or the like when such a tool is required. Aquatic divers have also utilized conventional canes, broomsticks and the like to use under water to poke into cracks to remove shellfish, lift rocks and the like; howevever, it will be understood that such a stick must be carried into the water, and always requires the use of one hand to hold the stick. Such a device can therefore slow down swimming, and generally limit the maneuverability of a diver. Furthermore, such a stick is usable only as a stick of a given length, and cannot be used in any special circumstances for any special functions. A conventional cane or stick is especially inconvenient, and may be hazardous, while a diver is getting into the water and when he is getting out of the water since the stick requires one hand that could otherwise be used for climbing, or for control.

SUMMARY OF THE INVENTION

The present invention overcomes the above mentioned and other difficulties with the prior art by providing a telescoping prod conveniently fastenable to a person's body to allow freedom of movement. The telescoping prod can selectively be extended to a sufficient length to allow a person to poke into cracks and crevices. Additionally, the telescoping prod of the present invention includes a remotely operable pickup, the pickup being operable regardless of the amount of telescoping or extension of the prod. The extending end of the prod can selectively receive other tools as may be desired.

BRIEF DESCRIPTION OF THE DRAWINGS

These and other features and advantages of the present invention will become apparent from consideration of the following specification when taken in conjunction with the accompanying drawings in which.

DESCRIPTION OF AN EMBODIMENT OF THE INVENTION

Figure 1:
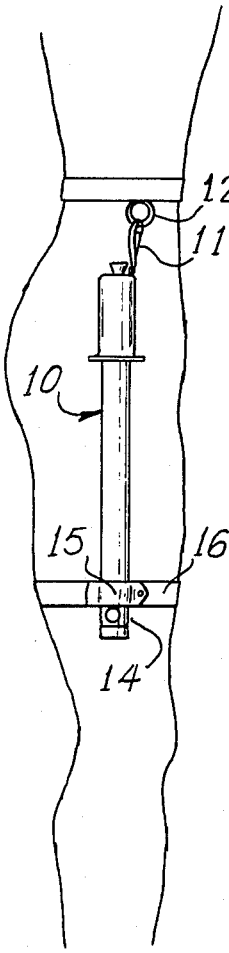
FIG. 1 is an elevational view showing a telescoping prod made in accordance with the present invention, the prod being mounted on a person's body.

Referring now more particularly to the drawings, and to that embodiment of the invention here presented by way of illustration, it will be seen in FIG. 1 of the drawings that the prod generally designated at 10 has a hook 11 by which the prod 10 is attached to a ring 12 carried by a belt or the like worn by a person. It will be understood that a diver will conventionally have a weight belt, and of course there are numerous other forms of belts designed for hanging or holding various tools. It will further be understood that the prod 10 need not be carried on the diver's belt, but may be made in different sizes to be carried on an arm, on the lower part of the leg, or otherwise as desired. As will become apparent from the discussion below, it is contemplated that the length of the prod 10 will allow it to be placed along a body member for the greatest freedom in swimming or other activity, and appropriate fastening means can be provided to fix the prod adjacent to the body member.

The lower end 14 of the prod 10 is here shown as releasably held by a fastener 15 carried by a leg-band 16. The fastener 15 should be easily releasable by means of a snap or other quick release fastener so the prod 10 can be removed quickly and easily, even when a person is underwater. The importance of the above described arrangement will be readily understood for a diver or the like since this arrangement allows the prod 10 to be carried on the belt so the person's hands are free.

The fastener 15 is important both to prevent the prod 10 from moving up when the diver jumps into the water, and to hold the prod 10 along the body while the diver is swimming in a horizontal position. In the first case, it will be understood that the prod 10 would be caught by the water and moved upwardly, and could engage some portion of the diver's body and cause pain or other trauma. While the diver is swimming, with his body in a horizontal position, if the prod 10 dangles downwardly, the prod could engage various obstacles and generally cause difficulty in swimming.

While the prod 10 can be made in virtually any length desired, it will be noted that, in FIG. 1, the prod hangs from the belt and the lowermost end of the prod stops short of the person's knee. This is a preferred arrangement because the prod 10 lies along the person's thigh and will remain generally parallel to the body member with no protuberance therefrom. It will of course be realized that the prod may extend beyond the knee; however, when the leg is bent the prod will extend beyond the body and may cause interference with some obstacles.

Figure 2:
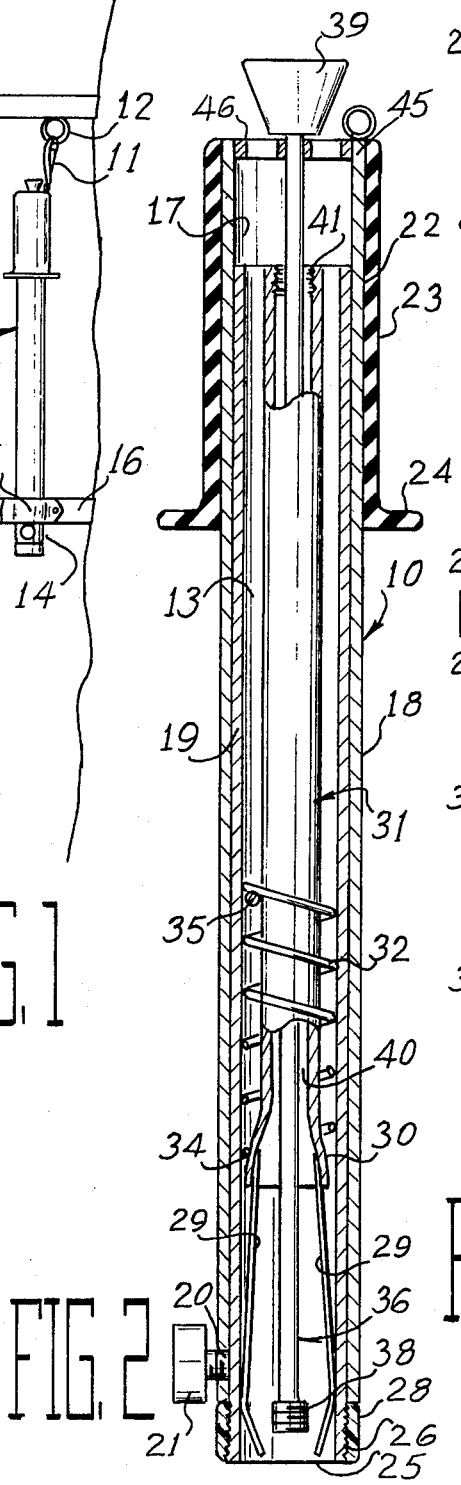
FIG. 2 is an enlarged longitudinal cross-sectional view showing the prod illustrated in FIG. 1, the prod being collapsed to its greatest extent.

Attention is next directed to FIG. 2 of the drawings for an understanding of the construction of the prod 10. Here it will be seen that the prod 10 includes an outer member 18 having an inner member 19 slideably received within an opening 17. These two members 18 and 19 constitute the primary structural members of the telescoping prod 10, and the two members are held in the desired telescoping relationship by a set screw 20 having a knob 21 fixed thereto.

The set screw 20 is threadedly received by the member 18 and selectively abuts the inner member 19. The knob 21 can be virtually any shape or size, but should be sufficiently easy to manipulate that a person under water will have no difficulty in loosening or tightening the set screw 20.

The upper portion of the outer member 18 defines a handle 22, and is here shown as receiving a grip 23 thereover. Obviously, the person could simply grasp the bare handle 22, but the grip 23 provides a better hold and may include a flange 24 to limit movement of the person's hand on the prod 10.

The extending end 25 of the inner member 19 is here shown as having threads 26. The threads 26 receive a band 28 or the like in the nature of a thread protector. This will be discussed in more detail hereinafter.

Within a central opening 13 in the inner member 19, there is a pair of gripping fingers 29. Gripping fingers such as the fingers 29 are well known in the art, it being understood that the fingers 29 are normally biased outwardly so that, when the fingers 29 are projected from the opening 13, the fingers 29 will move apart; then, when the fingers 29 are retracted back into the member 19, the end 25 of the member 19 will urge the finger 29 inwardly.

The fingers 29 are here shown as attached to the bell-shaped end 30 of a tubular member 31. The tubular member 31 extends generally from the fingers 29 to the opposite end of the inner member 19. To hold the tubular member 31 in place, there is a spring 32 that is fixed to the bell-shaped end 30 at 34, and is fixed to the inner member 19 by means of a pin 35. With this arrangement, it will be understood that the tubular member 31 can be urged downwardly as shown in the drawings, and the spring 32 will be stretched and the fingers 29 will be projected from the end 25 of the inner member 19. When force is removed from the tubular member 31, the tension of the spring 32 will pull the tubular member 31 back into the inner member 19, thereby retracting the fingers 29 into the inner member 19.

The operating means to effect the motion of the tubular member 31 comprises a rod 36 which extends through the tubular member 31. The rod 36 has an enlarged, externally threaded end 38 at its lower end, and the rod mounts a knob 39 at its upper end. It will be seen that the tubular member 31 has a generally uniform internal opening 40, but the opening 40 is of diminished size at its uppermost end, and includes internal threads designated at 41.

With the above described arrangement, it should now be understood that the externally threaded member 38 can be moved upwardly by pulling the knob 39 upwardly, and the member 38 will pass through the bore 40 of the tubular member 31 until the externally threaded member 38 engages the internal threads 41. The threads 38 and 41 will interlock with appropriate rotation of the rod 36. At this point it will be seen that there is an extended operating means for the fingers 29.

Figure 3:
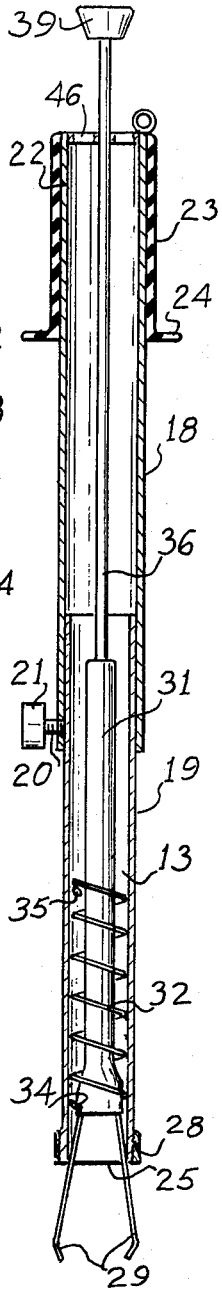
FIG. 3 is a longitudinal cross-sectional view of the prod shown in FIG. 2, the prod being shown on a reduced scale, and extended; and, FIG. 4 is an elevational view similar to FIG. 3, and showing a special purpose tool received on the end of the prod.

Looking now at FIG. 3 of the drawings, the prod 10 is shown in its extended form, with the rod 36 engaged with the tubular member 31 so that motion of the rod 36 can cause motion of the tubular member 31. It will also be seen that the inner member 19 is extended from the outer member 18 to increase the total length of the prod 10. Even in this extended condition, it will be seen that the fingers 29 are readily operable by means of the knob 39, motion of knob 39 in a downward direction causing projection of the fingers 29 and release of the knob 39 allowing retraction of the fingers 29 by means of the spring 32.

In the position shown in FIG. 3 of the drawings, the thread protector 28 remains in place so that, as the prod 10 is utilized to poke into crevices between rocks and the like, the threads 26 will not be mutilated. Additionally, it is contemplated that the thread protector 28 will be easily visible by being fluorescent and/or brightly colored. When a diver is using natural light, the water may be sufficiently murky that it is difficult to see, and a brightly colored thread protector 28 will allow the diver to know the location of the end of his prod. If the diver is using artificial light, a fluorescent thread protector 28 will catch the light from the flashlight and, again, let the diver know the location of the end of his prod.

Figure 4:
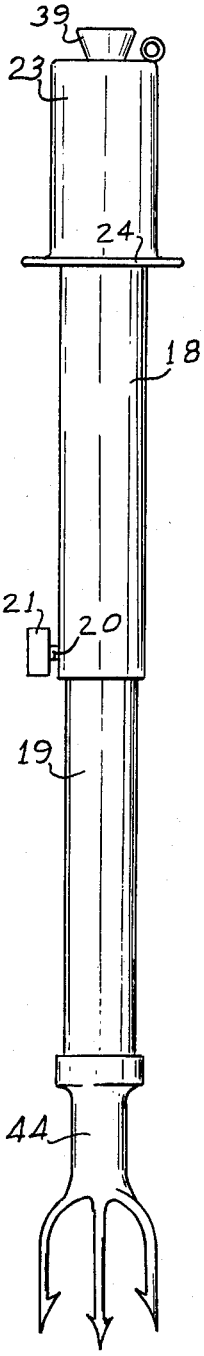

It will be uderstood that, if the fingers 29 are not to be used, the externally threaded member 38 may not be engaged with the internal threads 41. In this condition, the fingers 29 are not operable, but a telescoping prod is provided. Also, as is illustrated in FIG. 4 of the drawings, the threads 26 provide means for receiving other tools that may be utilized by the diver. FIG. 4 of the drawings illustrates the prod 10 in the condition shown in FIG. 3 of the drawings, but the end 25 of the member 19 receives a gig 44. It will be realized by those skilled in the art that the gig 44 is by way of illustration only, and numerous other tools could be similarly mounted, including a knife, hook or the like.

Referring again to FIG. 2 of the drawings, it will be seen that there is a continuous passageway 13 through the center of the inner member 19. This passageway 13 will of course contain air before the diver gets into the water, and it is desirable to provide a vent to allow the air to be quickly replaced by water. The uppermost end 45 of the outer member 18 is here shown as including a spider 46, the spider 46 including a guide for the rod 36, and allowing air to escape around the rod 36. It is also possible to omit the spider 46, and utilize a larger knob 39 substantially to close the end 45 of the outer member 18. In this event, one may wish to use a reticulated knob 39 to allow air to escape therethrough.

It will also be readily understood by those skilled in the art that the threaded engagement utilizing the threads 38 and 41 is one simple means to effect the desired locking and unlocking. It will be obvious to those skilled in the art that other mechanical arrangements may be used, including bayonet locks and the like. Furthermore, additional locking means may be arranged along the rod 36 so the rod 36 can be locked in several different positions with respect to the tubular member 31. In using threads such as the threads 38, it will of course be understood that the enlarged threaded member could simply be screwed completely through the internally threaded member 41, and the rod 36 could be moved further to engage the next externally threaded member. Other simple arrangements will suggest themselves.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A telescoping prod including an outer member having an opening therethrough, an inner member receivable within said opening through said outer member and slidable with respect thereto, said inner member being extendable from a first end of said outer member, the opposite end of said outer member defining a handle for said prod, means for selectively fixing the position of said inner member with respect to said outer member, pickup means carried by the extending end of said inner member, and operating means for selectively operating said pickup means, said operating means including an operating knob adjacent to said handle, said operating means further including a tubular member carrying said pickup means, a rod member slidable within said tubular member, said rod member carrying said operating knob at its rearmost end, the forward end of said rod member being selectively fixable to the rear end of said tubular member, the arrangement being such that said operating means can be telescoped to be the length of said outer member, and selectively extended for operating said pickup means.

2. A telescoping prod as claimed in claim 1, said inner member defining an opening therethrough, said operating means being within said opening through said inner member, said pickup means including a plurality of fingers within said opening in said inner member, said plurality of fingers being carried by said tubular member adjacent to said extending end of said inner member, and spring means for urging said tubular member into said inner member and holding said plurality of fingers within said inner member.

3. A telescoping prod as claimed in claim 2, said prod having a total minimum length approximately equal to the length of a body member of a person, and fastening means for releasably fastening said prod adjacent to said body member.

4. A telescoping prod as claimed in claim 3, said body member being the thigh, said fastening means including a hook for fixing said handle to the waist of the person, and band means for fixing said first end of said outer member to the thigh of the person.

5. A telescoping prod as claimed in claim 1, and further including threads on said extending end of said inner member, said threads selectively receiving an easily visible thread protector and a tool for use with said prod.

6. A telescoping prod as claimed in claim 2, said rod having a threaded protion at its forward end slidable within said tubular member, said tubular member having an internally threaded portion at its rear end, said threaded portion on said rod member being engageable with said internally threaded portion of said tubular member for locking said rod member with respect to said tubular member.

* * * * *